428-8
5/16/86 03 4,612,218

United States Patent [19]

Enterline

[11] Patent Number: 4,612,218

[45] Date of Patent: Sep. 16, 1986

[54] ARTIFICIAL CHRISTMAS TREES

[76] Inventor: Bettye J. Enterline, 8236 NW. 30th St., Bethany, Okla. 73008

[21] Appl. No.: 782,096

[22] Filed: Sep. 30, 1985

[51] Int. Cl.[4] ..... A47G 33/06

[52] U.S. Cl. ..... 428/8; 248/27.8; 428/18

[58] Field of Search ..... 428/18, 19, 20, 8; 248/27.8

[56] References Cited

U.S. PATENT DOCUMENTS

| | | | |
|---|---|---|---|
| D. 167,627 | 9/1952 | Hartman | D11/118 X |
| 2,615,583 | 10/1952 | Johnson | 108/152 |
| 3,170,587 | 2/1965 | Beeber | 428/18 X |
| 3,581,419 | 6/1971 | McCracken | 428/18 X |
| 3,713,957 | 1/1973 | Hermanson | 428/20 X |
| 3,819,457 | 6/1974 | Mottel | 428/18 X |
| 3,857,748 | 12/1974 | Thomann | 428/20 X |
| 3,974,915 | 8/1976 | Mieuli, Jr. | 428/23 X |
| 4,106,228 | 8/1978 | Gibrich | 428/8 X |
| 4,109,036 | 8/1978 | Lloyd et al. | 428/20 X |

OTHER PUBLICATIONS

Table Top Christmas Trees, p. 117 of the Jan. 1937 issue of Popular Mechanics.

*Primary Examiner*—Henry F. Epstein
*Attorney, Agent, or Firm*—Laney, Dougherty, Hessin & Beavers

[57] ABSTRACT

An artificial Christmas tree of the narrow dimension variety that is easily stored and assembled for use as supported on a vertical wall or door structure. The artificial tree consists of a triangular panel member that includes a plurality of equispaced apertures and mounting rings for attachment to an adjacent supporting structure. A plurality of limb fronds of varying length and configuration may then be selectively inserted in selected ones of the apertures thereby to achieve a desired Christmas tree effect for subsequent support of the traditional Christmas tree decorations.

9 Claims, 5 Drawing Figures

ARTIFICIAL CHRISTMAS TREES

BACKGROUND OF THE INVENTION

1. Field of the Invention

The invention relates generally to artificial Christmas trees and more particularly, but now by way of limitation, it relates to an improved Christmas tree device of generally flat construction that is particularly desirable for use in apartments or other locations that may be restricted as to space or access.

2. Description of the Prior Art

Some prior attempts at artificial Christmas tree construction have departed from the full, three-dimensional structures by providing certain tree devices that are adapted for support on doors or the like or that are constructed in a generally narrow dimensional layout. U.S. Pat. No. 4,109,036 in the name of Lloyd et al is of interest as it relates to an artificial Christmas tree that is adapted for disposition on a wall to provide a tree-like presentation. This wall tree includes an upright pole which may be fastened as by screws to the baseboard thereafter to receive a plurality of artificial branches. Such structures may be wall-type, corner-type or still a different angular fit as desired, and this type of artificial tree still requires base and trunk structure.

U.S. Pat. No. 3,581,419 to McCracken discloses door-hung type of tree structure that is constructed from solid foam plastic and is intended for use in holding Christmas greeting cards for display. U.S. Pat. No. D. 167,627 in the name of Hartman discloses another similar form of card display stand that is supported on a base/central axis structure. Also of general interest are U.S. Pat. Nos. 2,615,583 and 3,857,748 which teach narrow dimension artificial tree structures.

SUMMARY OF THE INVENTION

The present invention is an easily assembled, readily stored artificial Christmas tree that consists of a backing panel of tree-like configuration having a large plurality of generally equi-spaced mounting holes therethrough. The backing panel is supported on a vertical surface and functions in combination with a plurality of variously structured limb fronds to define a narrow dimensional tree structure. The artificial tree structure may be formed in any of various colors for use in accordance with the decorator's fancy.

Therefore, it is an object of the present invention to provide a narrow dimensional artificial Christmas tree that exhibits greater economy and ease of handling and storage.

It is also an object of the present invention to provide an artificial Christmas tree that is particularly desirable for use by apartment dwellers.

It is yet another object of the present invention to provide an artificial tree that is capable of providing fullest Christmas effect and yet can be quickly disassembled and readily stored for subsequent usage.

Finally, it is an object of the present invention to provide a narrow dimensional artificial Christmas tree that requires relatively few diverse components and may be readily assembled to give Christmas holiday decorator effects.

Other objects and advantanges of the invention will be evident from the following detailed description when read in conjunction with the accompanying drawings which illustrate the invention.

DETAILED DESCRIPTION OF THE INVENTION

Figure 1:
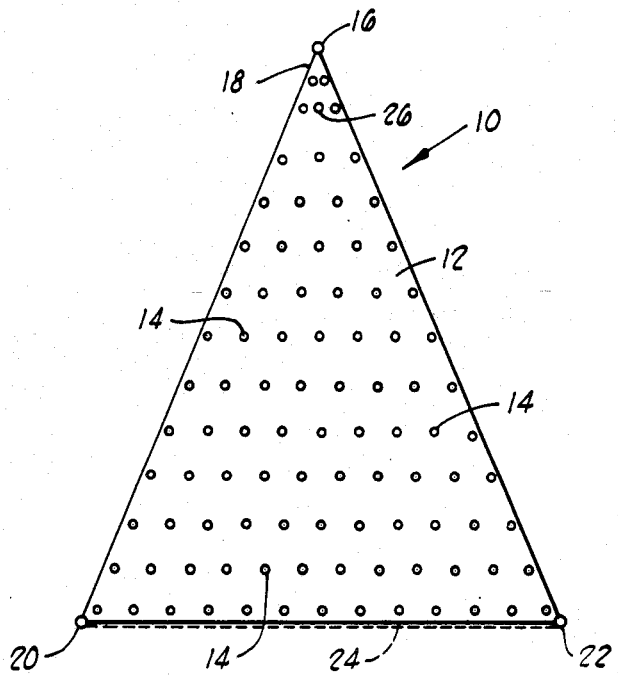
FIG. 1 is a plan view of a tree backing panel constructed in accordance with the present invention.

FIG. 1 illustrates a back panel 10 which consists of a generally triangularly shaped panel member 12 that includes a plurality of holes or apertures 14 formed therethrough. A mounting ring 16 is secured at the apex 18 of panel member 12. The mounting ring 16 may be suitably attached as by stitching, plastics bonding or the like, and mounting ring 16 provides an opening through which a nail or suitable fastener may be received to secure the panel member 12 on a supporting wall, door back or the like.

A pair of securing rings 20 and 22 are similarly secured to the respective lower corners of panel member 12 and these serve to provide securing retainers for anchoring to the supporting surface. Alternatively, a stiffener rod 24 may be bonded along the lower edge of panel member 12 such that a single securing attachment at apex mounting ring 16 supports the backing panel 10 on the supporting surface.

The apertures 14 are shown formed in horizontal rows of equispaced apertures, each alternating row being laterally displaced relative to the next, and additional irregular holes or apertures 26 may be formed near the apex 18 to aid in filling out the most full and realistic tree effect, as will be further described below. The panel member 12 is formed of a suitable flexible yet sufficiently stiff sheet material of selected color. While normal expectancies might suggest a foilage green panel member 12, certain decorator applications may well require pink, light blue or any of various color selections. In a present form, the panel member 12 is comprised of a relatively heavy polyurethane sheet, e.g. on the order of $\frac{1}{8}$ to $\frac{1}{4}$ inch thickness and selected for suitable color. The individual apertures 14 may be formed so that they tightly receive co-acting limb members or apertures 14 and, optionally, they may be formed to include a small lip structure thereby to provide additional horizontal support of associated limb members.

Figure 2A:
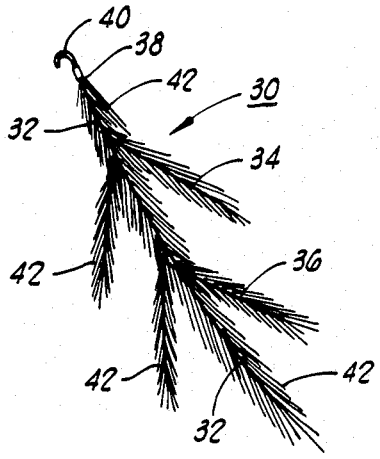
FIG. 2A is a plan view of one form of limb frond utilized in the present invention.

FIG. 2A illustrates a first form of greater limb frond 30 that is suitable for lower branch simulation. The frond 30 consists of a main limb shaft 32 and paired branch shafts 34, 36 with a shaft end 38 having a suitable hook or securing insert 40 wrapped or bonded thereon. Each of limb shafts 32, 34 and 36 then further include artificial needles 42 secured thereon. The entire limb frond 30, including limb shafts and needles 42, may be formed from molded plastic in selected color, or they may be formed from the old and well-known method of cellophane wrapping of wire frame structure.

Figure 2B:
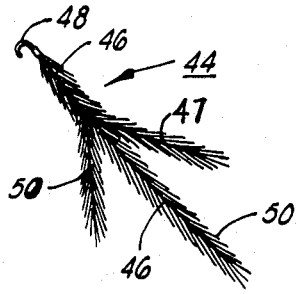
FIG. 2B is a plan view of a second form of limb frond utilized in the present invention.

FIG. 2B illustrates a lesser limb frond 44 which consists of a main shaft 46 and paired branch shaft 47 with a securing insert 48, and the shafts each support a plurality of needles 50. The lesser limb fronds 44 are suitable for use about the upper portions of backing panel 10 while the larger limb fronds 30 are utilized around the bottom extremities to fill out the tree effect. It is obvious of course that still other variations in both length and fullness may be utilized to give best tree effects. Also, while securing inserts 40 and 48 are shown in hook form, this is but one of the simpler fastener arrangements since an interconnection assuring tight affixure and support of the limb fronds into the apertures 14 may be effected in any of a number of suitable ways.

Figure 3:
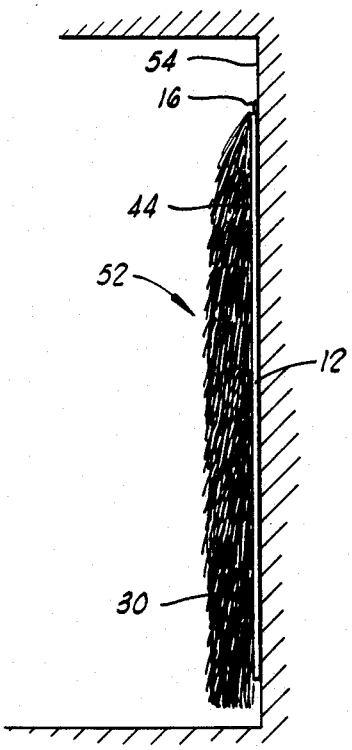
FIG. 3 is a side view in elevation of the assembled artificial Christmas tree.
Figure 4:
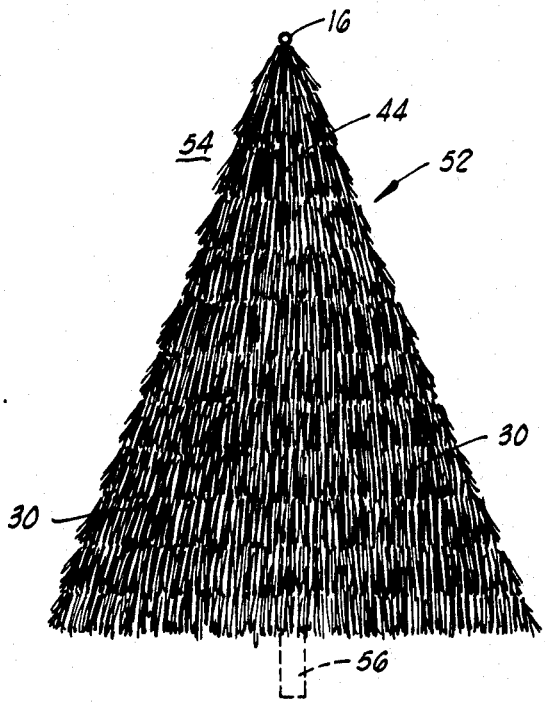
FIG. 4 is a front view in elevation of the Christmas tree of the present invention.

Referring to FIGS. 3 and 4, the assembled artificial tree 52 is shown with panel member 12 secured on a wall surface 54 as mounting ring 16 is suitably secured thereon. The lower edge of panel member 12 may be maintained by either the mounting rings 20, 22, the stiffener rod 24 or both. The limb fronds 30, 44 are then placed on panel member 12 in whatever manner the decorator deems best to give the optimum Christmas tree effect. Thus, the greater fronds 30 are suitably disposed with inserts 40 through respective apertures 14 along the bottom extremities of panel member 12, and lesser fronds 44 are similarly attached in insertion throughout the upper regions and the apex 18 of panel member 12.

It should be understood that selected numbers and spacings of apertures 14 may be utilized in specific patterns to enable diverse limb configurations, and the relative orientation or alignment of limb fronds may be further adjusted to vary the tree effect. Once the desired artificial tree form is achieved, traditional Christmas decoration of the tree can commence with placement of tinsel, lights, top star, icicles and the like. Still further decorator effect can be achieved with securing of suitable lower structure, e.g. trunk or pot effect structure 56 (FIG. 4), to the wall supporting structure.

After usage, the artificial tree 52 may be readily disassembled by removal of each of the individual limb fronds 30 and 44 and removal of the panel member 12 from its supporting affixure on the wall structure. The plurality of limb fronds 30 and 44 may then be neatly placed on panel member 12 and rolled up and secured for suitable storage disposition. The storable roll takes relatively small volume as the entire tree structure is safely stored away.

Changes may be made in combination and arrangement of elements as heretofore set forth in the specification and shown in the drawings; it being understood that changes may be made in the embodiments disclosed without departing from the spirit and scope of the invention as defined in the followings claims.

What is claimed is:

1. A device for attachment to a vertical structure for simulation of a Christmas tree, comprising:

a panel member formed of plastic sheet material that is rigid yet bendable and shaped in a generally triangular shape with an apex end and opposite end corners, and having a plurality of spaced apertures formed therethrough with said apertures formed in generally equi-spaced disposition over the entire panel area;

securing means for fastening said apex end on said vertical structure to support said panel member adjacent thereto; and a plurality of limb fronds each having one end formed as an insert for secure affixture within a respective one of said apertures whereby said panel member and limb fronds effect said simulation.

2. A device as set forth in claim 1 wherein:

said plastic sheet is polyurethane.

3. A device as set forth in claim 1 wherein:

said plastic sheet has a uniform thickness exceeding one-eighth inch.

4. A device as set forth in claim 1 wherein said securing means comprises:

ring means secured to said plastic sheet material to receive a mounting fastener therethrough.

5. A device as set forth in claim 1 wherein said limb fronds each comprise:

a main shaft having an insert means secured on one end;

plural branch shafts extending from said main shaft at an obtuse angle and spaced from said one end; and simulated needle structure secured along all of the main and plural shafts.

6. A device as set forth in claim 5 wherein:

said main and plural branch shaft combination are formed in greater and lesser configurations for placement at respective lower and upper extremities of said panel member.

7. A device as set forth in claim 5 wherein:

said main and plural shafts are unitarily formed from plastic.

8. A device as set forth in claim 1 which further includes:

additional second and third securing means affixed to respective opposite end corners.

9. A device as set forth in claim 1 which further includes:

stiffener rod means secured across the panel member between opposite end corners.

* * * * *